US009016841B2

(12) United States Patent
Johnson et al.

(10) Patent No.: US 9,016,841 B2
(45) Date of Patent: Apr. 28, 2015

(54) METHODS AND DEVICES FOR VENTING AIR FROM INK JET PRINTER SUBASSEMBLIES USING OLEOPHOBIC MEMBRANES

(71) Applicant: Palo Alto Research Center Incorporated, Palo Alto, CA (US)

(72) Inventors: David Matthew Johnson, San Francisco, CA (US); Norine Chang, Menlo Park, CA (US); Eric J. Shrader, Belmont, CA (US); John S. Paschkewitz, San Carlos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 13/856,424

(22) Filed: Apr. 3, 2013

(65) Prior Publication Data

US 2014/0300666 A1 Oct. 9, 2014

(51) Int. Cl.

| | |
|---|---|
| ***B41J 2/175*** | (2006.01) |
| ***B41J 2/14*** | (2006.01) |
| ***B41J 2/16*** | (2006.01) |

(52) U.S. Cl.

CPC ..... *B41J 2/1433* (2013.01); *B41J 2/162* (2013.01); *Y10T 29/49401* (2015.01); *B41J 2/14233* (2013.01); *B41J 2202/07* (2013.01)

(58) Field of Classification Search

CPC ..... B41J 2/175; B41J 2/17563; B41J 2/19; B41J 2/1631

USPC ..... 347/84, 85, 44

See application file for complete search history.

(56) References Cited

U.S. PATENT DOCUMENTS

| | | | | |
|---|---|---|---|---|
| 6,502,924 | B1 | 1/2003 | Muramatsu et al. | |
| 6,969,165 | B2 | 11/2005 | Olsen | |
| 7,159,974 | B2 | 1/2007 | Gray et al. | |
| 2004/0165040 | A1 * | 8/2004 | Olsen | 347/85 |
| 2005/0168540 | A1 * | 8/2005 | Wilson et al. | 347/85 |
| 2006/0023038 | A1 * | 2/2006 | Seu | 347/85 |
| 2006/0044367 | A1 * | 3/2006 | Campillo et al. | 347/85 |
| 2006/0090645 | A1 * | 5/2006 | Kent | 95/46 |
| 2011/0157278 | A1 | 6/2011 | Gulvin et al. | |
| 2011/0279516 | A1 | 11/2011 | Hu et al. | |
| 2012/0044298 | A1 | 2/2012 | Sambhy et al. | |
| 2014/0071205 | A1 * | 3/2014 | Platt et al. | 347/54 |

OTHER PUBLICATIONS

Jan. 12, 2015, File History for U.S. Appl. No. 13/856,427.

* cited by examiner

*Primary Examiner* — Matthew Luu
*Assistant Examiner* — Patrick King
(74) *Attorney, Agent, or Firm* — Hollingsworth Davis, LLC

(57) ABSTRACT

An ink jet printer subassembly comprises an ink flow channel that includes an oleophobic membrane configured to contain ink in the ink flow channel while allowing air to vent out of the ink flow channel through the oleophobic membrane.

16 Claims, 9 Drawing Sheets

METHODS AND DEVICES FOR VENTING AIR FROM INK JET PRINTER SUBASSEMBLIES USING OLEOPHOBIC MEMBRANES

TECHNICAL FIELD

This application relates generally to air removal from ink jet printer subassemblies. The application also relates to components, devices, systems, and methods pertaining to such air removal techniques.

BACKGROUND

Solid ink jet printers can encounter significant problems with air bubbles that form when the ink in the print head is frozen and then re-melted. These air bubbles cause printing defects and as a result the print head may need to be purged after a freeze and melt cycle. The resultant purge mass increases the cost per page and is not desirable.

SUMMARY

Embodiments disclosed herein involve an ink jet printer subassembly comprising an ink flow channel that includes an oleophobic membrane configured to contain ink in the ink flow channel while allowing air to vent out of the ink flow channel through the oleophobic membrane.

The oleophobic membrane may be located in a manifold of an ink jet print head and the oleophobic membrane is sealed across the ink flow channel.

According to some aspects, the oleophobic membrane has a pore diameter of between about 0.1 and about 10 microns. The oleophobic membrane may comprise an electrospun membrane of oleophobic material, such as a fluorinated polymer. In some implementations, the oleophobic membrane comprises a base substrate coated with the oleophobic material.

According to some aspects, the oleophobic membrane further comprises nanoparticles, the nanoparticles disposed on the oleophobic membrane, within the oleophobic membrane or disposed on and within the oleophobic membrane.

Some embodiments are directed to a subassembly for an ink jet printer. An ink flow channel of the ink jet printer includes an oleophobic membrane configured to contain ink in the ink flow channel while allowing air to vent through the oleophobic membrane and out of the ink flow channel. A mechanical backing is arranged on the oleophobic membrane.

The oleophobic membrane includes pores having a membrane pore diameter and the mechanical backing comprises openings having diameter that is at least two orders of magnitude greater than the mean membrane pore diameter. The mechanical backing may be made of glass filled PTFE. A seal can be used to seal the oleophobic membrane is across the ink flow channel.

Some embodiments are directed to a method of operating an ink jet printer. A phase change ink is moved through an ink flow channel of the ink jet printer and is confined in the ink flow channel by an oleophobic membrane. The ink is confined within the ink flow channel by the oleophobic membrane while the oleophobic membrane simultaneously vents air out of the ink flow channel. For example, the oleophobic membrane can have a pore size and ink contact angle such that a bleed through pressure for the ink through the oleophobic membrane is larger than the maximum operating pressure in the inkjet print head. For example, in some cases, the oleophobic membrane is disposed in the print head of the ink jet printer, the bleed through pressure of the oleophobic membrane is greater than about 8 psi, the pore size of the oleophobic membrane is greater than or equal to about 0.5 microns, and the print head is pressurized to a maximum pressure of 5 psi during normal operation.

Some embodiments involve a method of making an ink jet printer subassembly. A method includes forming a bubble mitigation device that includes an oleophobic membrane. The bubble mitigation device is sealed across a flow channel disposed within an ink jet printer. The bubble mitigation device is arranged to retain ink in the flow channel and to vent air out of the flow channel through the oleophobic membrane.

According to some aspects, forming the bubble mitigation device includes attaching a structural support having openings to the oleophobic membrane.

In some implementations, the bubble mitigation device is sealed across the flow channel by adhering the oleophobic membrane to one or more flow channel sides.

The bubble mitigation device may use an oleophobic membrane comprising an oleophobic material electrospun with a base material that is non-oleophobic.

The bubble mitigation device may use an oleophobic membrane comprising a base material coated with an oleophobic material. The oleophobic membrane can have nanoparticles disposed within and/or on the oleophobic membrane.

The above summary is not intended to describe each embodiment or every implementation. A more complete understanding will become apparent and appreciated by referring to the following detailed description and claims in conjunction with the accompanying drawings.

DESCRIPTION OF THE DRAWINGS

Like reference numbers refer to like components; and

Drawings are not necessarily to scale unless otherwise indicated.

DESCRIPTION OF VARIOUS EMBODIMENTS

Ink jet printers operate by ejecting small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. Some printers use phase-change ink which is solid at room temperature and is melted before being jetted onto the print media surface. Phase-change inks that are solid at room temperature advantageously allow the ink to be transported and loaded into the ink jet printer in solid form, without the packaging or cartridges typically used for liquid inks. In some implementations, the solid ink is melted in a page-width print head which jets the molten ink in a page-width pattern onto an intermediate drum. The pattern on the intermediate drum is transferred onto paper through a pressure nip.

In the liquid state, ink may contain air bubbles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that can be subsequently filled by air. When the solid ink melts prior to ink jetting, the air in the voids can become bubbles in the liquid ink.

Embodiments described in this disclosure involve techniques to reduce air bubbles in phase-change ink. Phase change ink is an oily liquid and the bubble mitigation techniques described herein involve membranes comprising oleophobic materials that selectively contain ink within ink channels of the ink jet printer while simultaneously allowing air to vent through the oleophobic membranes. Oleophobic materials are those that lack affinity for oils, and tend to repel oily substances.

Figure 1:
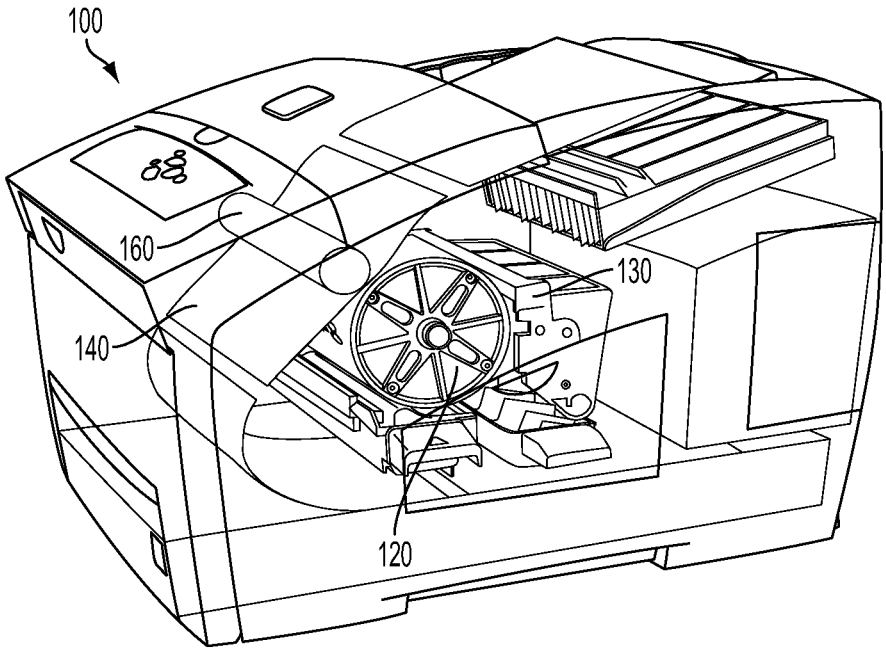
FIGS. 1 and 2 provide internal views of portions of an ink jet printer that incorporates one or more oleophobic membrane assemblies as described herein.
Figure 2:
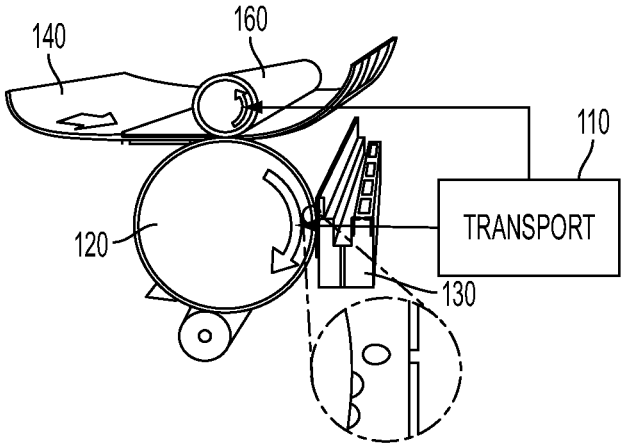

FIGS. 1 and 2 provide internal views of portions of an ink jet printer 100 that incorporates a bubble mitigation device as discussed herein. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
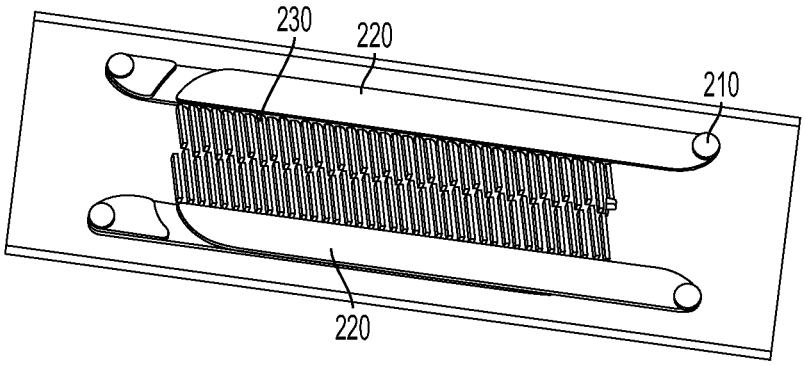
FIGS. 3 and 4 show views of an exemplary print head of the ink jet printer of FIG. 1.
Figure 4:
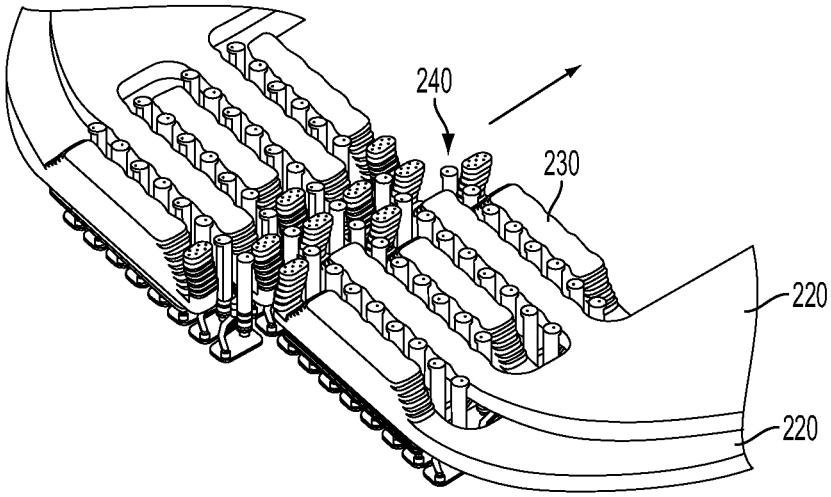

FIGS. 3 and 4 show more detailed views of an exemplary print head. The path of molten ink, contained initially in a reservoir, flows through a port 210 into a main manifold 220 of the print head. As best seen in FIG. 4, in some cases, there are four main manifolds 220 which are overlaid, one manifold 220 per ink color, and each of these manifolds 220 connects to interwoven finger manifolds 230. The ink passes through the finger manifolds 230 and then into the ink jets 240. The manifold and ink jet geometry illustrated in FIG. 4 is repeated in the direction of the arrow to achieve a desired print head length, e.g. the full width of the drum.

Figure 5:
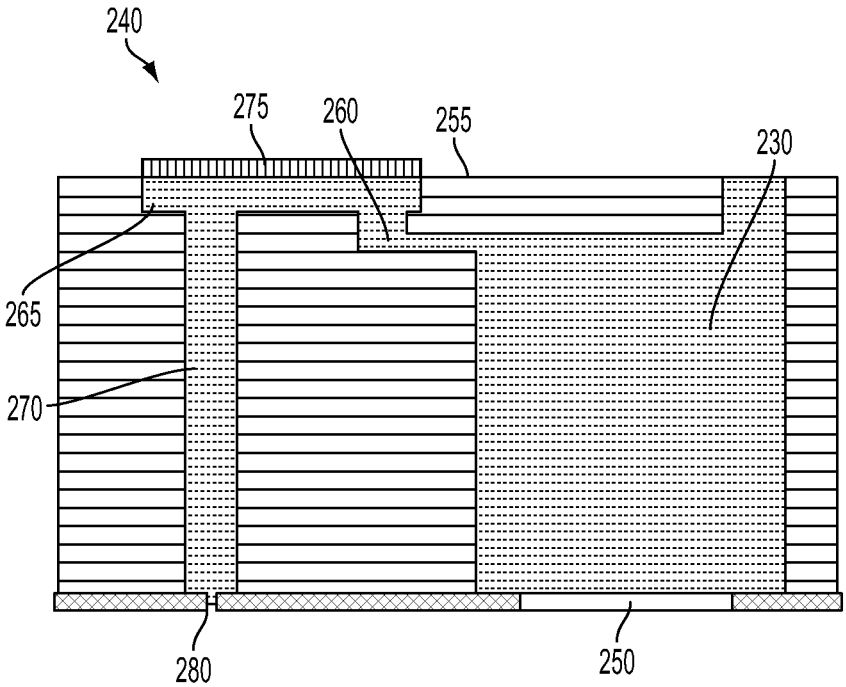
FIG. 5 provides a view of a finger manifold and ink jet which shows a possible location for oleophobic membrane assembly.

In some examples discussed in this disclosure, the print head uses piezoelectric transducers (PZTs) for ink droplet ejection, although other methods of ink droplet ejection are known and such printers may also use a bubble mitigation approaches that involve oleophobic membranes as described herein. FIG. 5 provides a more detailed view of a finger manifold 230 and ink jet 240 which shows a possible location for a bubble mitigation device 250 that incorporates an oleophobic membrane. In the example shown in FIG. 5, the bubble mitigation device 250 is located in the finger manifold 230. The location for the bubble mitigation device shown in FIG. 5 is illustrative only, because bubble mitigation assemblies as discussed herein may be located elsewhere along the ink flow path, such as in a main manifold, for example. The print head may include multiple bubble mitigation assemblies positioned at one or more locations, e.g., in each of the finger manifolds.

Activation of the PZT 275 causes a pumping action that alternatively draws ink into the ink jet body 265 and expels the ink through ink jet outlet 270 and aperture 280. The bubble mitigation device 250 allows air to vent from the finger manifold through an oleophobic membrane while containing the ink within the finger manifold and allowing ink (substantially devoid of air bubbles) to flow into the ink jet body 265.

Oleophobic materials can be used to form semipermeable membranes that allow passage of air but block passage of oily liquids, such as phase-change ink. The oily ink forms a high contact angle with oleophobic materials. The semipermeable oleophobic membranes discussed herein have small pores that allow air to pass through, but the high contact angle formed by the ink on the oleophobic material prevents the ink from passing through the small pores of the oleophobic membrane. The integrity of the oleophobic membranes to block the passage of ink can be maintained under pressure for sufficiently high contact angle between the ink and the oleophobic material and sufficiently small pore size.

Figure 6:
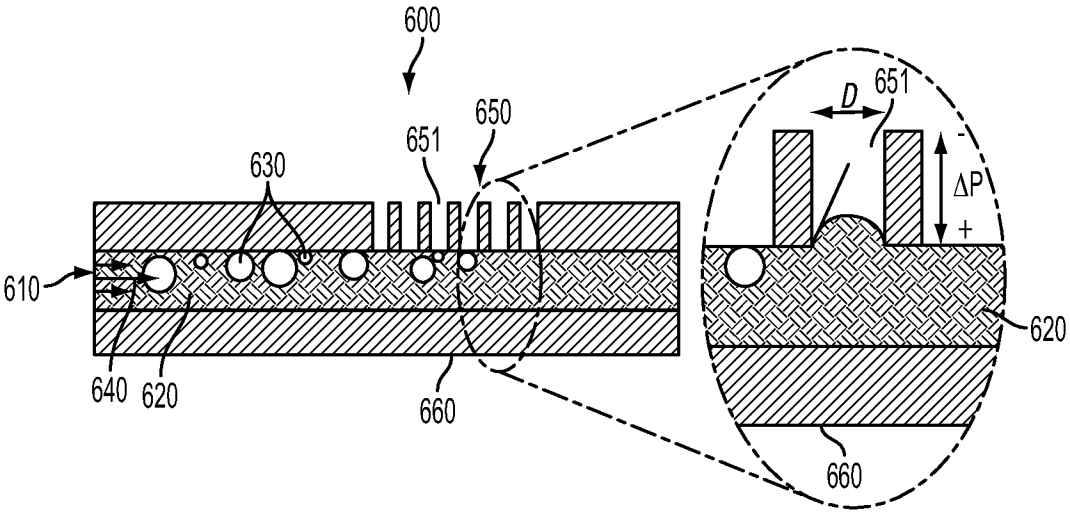
FIG. 6 shows an implementation of an oleophobic membrane in accordance with some embodiments.

The left side of FIG. 6 is a side cross sectional view of an ink flow channel 600 that shows an implementation of a bubble mitigation device comprising an oleophobic membrane 650 according to some embodiments. FIG. 6 shows an ink passage 610 that contains ink 620 and bubbles of air 630 in a portion of the passage 610. The ink 620 and air bubbles 630 flow through the passage 610 along the direction indicated by arrow 640. The oleophobic membrane 650 is disposed along a portion of the ink flow channel 600. The oleophobic membrane 650 comprises an oleophobic material and includes pores 651.

Figure 7:
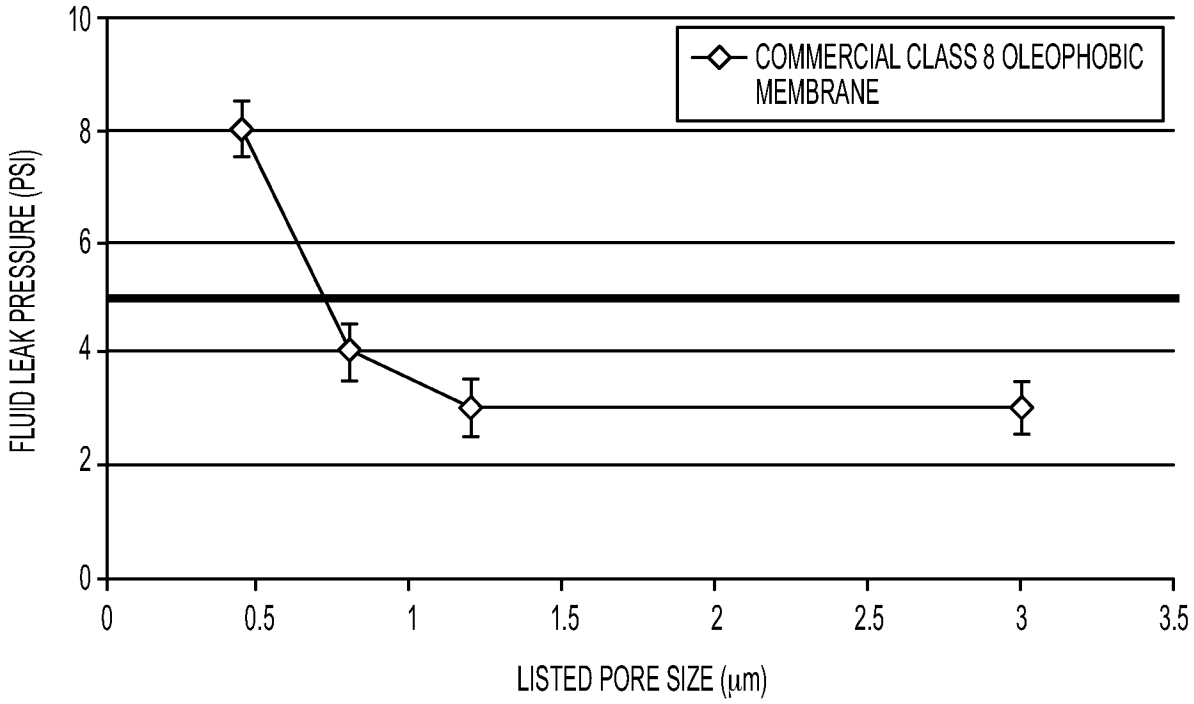
FIG. 7 shows the relationship between pore diameter and bleed-through pressure for a commercially available class 8 oleophobic membrane.

The right side of FIG. 6 shows an enlarged version of a portion 660 of the ink flow channel 600 showing a pore 651 of the oleophobic membrane 650. Each pore 651 has a diameter D. The ink 620 forms a contact angle, $\theta_c$, with the oleophobic membrane 650 at the location of the pore 651. The difference in pressure, ΔP, across the pore 651 needed to force the ink through the pore 651, referred to as the bleed-through pressure, is related to the contact angle and the pore diameter and can be expressed mathematically as:

$$\Delta P = \frac{4\gamma\cos(180 - \theta_c)}{D}$$

where $\theta_c$ is the contact angle between the ink and the oleophobic surface as illustrated in FIG. 6, D is the diameter of the pore, and γ is the surface tension at the liquid/air interface. For example, in some cases, a suitable pore diameter for the oleophobic membrane that prevents ink bleed out at pressures consistent with ink jet applications is between about 0.1 and about 10 μm. FIG. 7 shows the relationship between pore diameter and bleed-out pressure for a commercially available class 8 oleophobic membrane. In some embodiments, the bleed through pressure of the oleophobic membrane is greater than about 8 psi, the pore size of the membrane is greater than or equal to about 0.5 microns and the print head is pressurized to a maximum pressure of about 5 psi during normal operation at the location of the oleophobic membrane.

In some implementations, the oleophobic membrane may comprise an electrospun base material (which may be non-oleophobic) that is coaxially spun with an oleophobic material, such as a fluorinated polymer. In some implementations, the base material (which may be non-oleophobic) is electrospun and the oleophobic material is coated on the base material after the electrospinning process. Oleophobic membranes suitable for use in bubble mitigation assemblies discussed herein are available from various manufacturers, such as Pall, GE, and W. L. Gore. In some cases, it may be beneficial to add nanoparticles during the electrospinning (or coaxial electrospinning) process or during the coating process. The nanoparticles may be disposed on the oleophobic membrane, within the oleophobic membrane or disposed on and within the oleophobic membrane. The nanoparticles serve to increase the oleophobicity of the membrane by increasing nano-scale surface roughness of the membrane.

Figure 8:
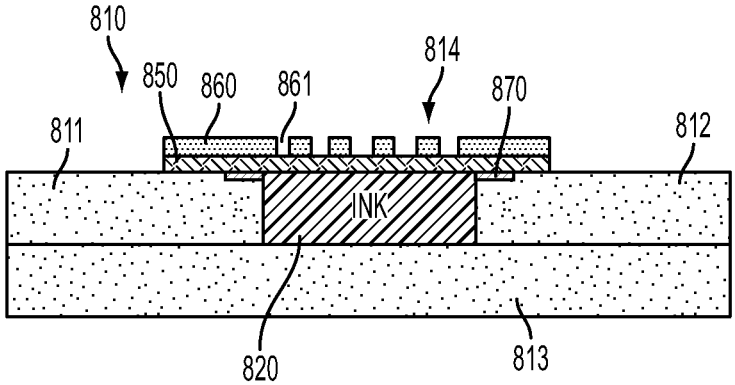
FIG. 8 illustrates an oleophobic membrane assembly that includes an oleophobic membrane and mechanical backing.

Oleophobic membranes can be somewhat fragile when used in ink jet printer applications. In some installations, the mechanical strength of the membrane is insufficient to prevent flexing and possible mechanical failure of the membrane. To enhance the structural integrity of the membrane, a mechanical backing may be used, as illustrated in the cross sectional view of a bubble mitigation device 814 depicted in FIG. 8. FIG. 8 shows an ink flow channel 810 formed by first, second, third, and fourth sides 811, 812, 813, 814 and containing ink 820. In the section of the channel 810 shown in FIG. 8, the fourth side of the ink flow channel 810 includes a bubble mitigation device 814 comprising an oleophobic membrane 850 and mechanical backing 860. The material of the mechanical backing 860 has a mechanical strength sufficient to prevent plastic deformation of the membrane 850 either due to thickness of the backing or materials of construction. The backing material need not be oleophobic. For example, in some implementations, the mechanical backing material may comprise glass filled polytetrafluoroethylene (PTFE), stainless steel, aluminum, polysulfone, polycarbonate, polyether ether ketone (PEEK) and/or polyphenylene sulphide (PPS).

Figure 9:
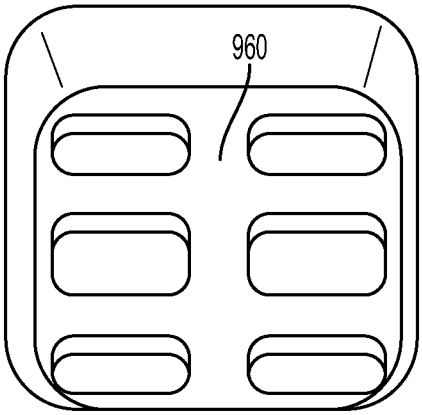
FIG. 9 shows a glass filled PTFE mechanical backing for an oleophobic membrane assembly.

The oleophobic membrane 850 is similar to the membrane 650 depicted in FIG. 6, having membrane pores (not shown in FIG. 8) that allow air to vent through the oleophobic membrane 850 while containing ink 820 within the ink channel. The contact angle of the ink with the oleophobic material and the diameter of the membrane pores is sufficient to contain the ink 820 within the channel 810, even at pressures needed for ink jet operations, e.g., in a range of about 0 to about 10 psi. The mechanical backing 860 has structural openings 861, wherein the diameter of the backing openings 861 are at least about 2 orders of magnitude larger than the pore diameter of the oleophobic membrane pores. As shown in FIG. 8, a seal 870 can be disposed between the bubble mitigation device 814 and portions of the ink channel 810. The oleophobic membrane 850 is sealed to the sides 811, 812 of the ink channel, e.g., the oleophobic membrane 650 can be sealed across a portion of the ink flow channel using an adhesive and/or can be sealed through compression. As shown in FIG. 8, a portion of the oleophobic membrane 850 is disposed and sealed between the backing 860 and the ink flow channel sides 811, 812. Sealing the oleophobic membrane across a portion of the ink flow channel prevents the ink 820 from wicking out of the ink channel through a path that could be created between the backing 860 and the ink flow channel sides 811, 812. FIG. 9 shows a glass filled PTFE mechanical backing 960 for a bubble mitigation device.

Figure 10:
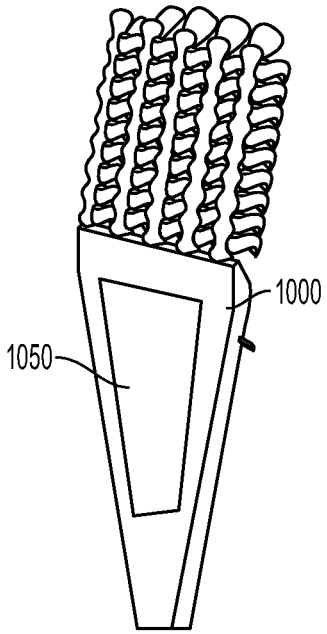
FIG. 10 illustrates the placement of an oleophobic membrane assembly on a surface of a printhead finger manifold.

As previously discussed, the bubble mitigation assemblies described herein can be disposed in a variety of locations along the ink flow path of an ink jet printer, including the siphon and manifold sections as illustrated in FIGS. 3-5. FIG. 10 illustrates the placement of an oleophobic membrane assembly 1050 on a surface of a printhead manifold 1000.

Figure 11:
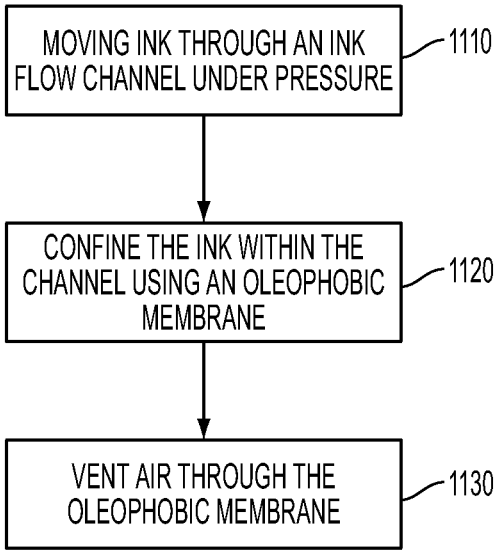
FIG. 11 is a flow diagram illustrating a process of using an oleophobic membrane assembly to vent air from an ink jet printer ink flow channel.

FIG. 11 is a method of using oleophobic membrane for bubble mitigation in ink jet printer applications. The method involves moving 1110 ink through an ink flow channel under pressures sufficient to flow ink, e.g., 3 psi. The ink is confined 1120 within the ink flow channel by at least one oleophobic membrane. The oleophobic membrane simultaneously confines the ink to the channel while venting 1130 air through the oleophobic membrane.

Figure 12:
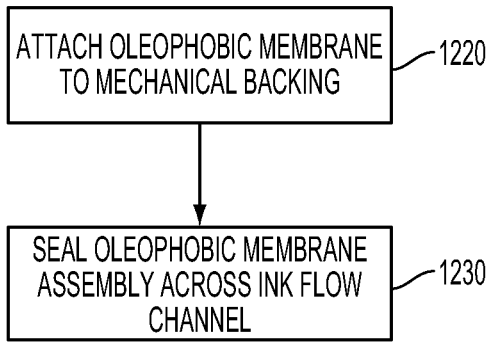
FIG. 12 is a flow diagram illustrating a process for fabricating an oleophobic membrane assembly.

FIG. 12 illustrates a method of making an ink jet printer subassembly that includes an oleophobic membrane. According to a two-step process, an oleophobic membrane may be formed by electrospinning a base material and then coating an oleophobic substance on the base material. Alternatively, in a one-step process, the base material and oleophobic material can be coaxially spun to form an oleophobic membrane. The oleophobic membrane is placed adjacent to a mechanical backing, which may be attached 1220 to the oleophobic membrane, by mechanical means or by gluing the mechanical backing to the oleophobic membrane. A seal is disposed between the oleophobic membrane assembly and sides of the ink channel. The oleophobic membrane assembly is sealed 1230 to the ink channel.

Various modifications and additions can be made to the preferred embodiments discussed above. Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

What is claimed is:

1. An ink jet printer subassembly, comprising:

an ink flow channel located in a manifold of an ink jet print head, the ink flow channel including an oleophobic membrane configured to contain ink in the ink flow channel while allowing air to vent out of the ink flow channel through the oleophobic membranes;

a mechanical backing attached to the oleophobic membrane, the mechanical backing having a mechanical strength sufficient to prevent deformation of the membrane; and a seal between the oleophobic membrane and the ink flow channel and arranged to seal the oleophobic membrane between the mechanical backing and the ink flow channel, wherein the oleophobic membrane includes nanoparticles that are disposed on, within, or both on and within the oleophobic membrane.

2. The ink jet printer subassembly of claim 1, wherein the oleophobic membrane has a pore diameter of between about 0.1 and about 10 microns.

3. The ink jet printer subassembly of claim 1, wherein the oleophobic membrane comprises an electrospun membrane of oleophobic material.

4. The ink jet printer subassembly of claim 1, wherein the oleophobic membrane comprises a base substrate coated with an oleophobic material.

5. The ink jet printer subassembly of claim 1, wherein the oleophobic membrane comprises a fluorinated polymer.

6. A subassembly for an ink jet printer, comprising:

an ink flow channel including:

an oleophobic membrane comprising pores having a mean membrane pore diameter, the oleophobic membrane configured to contain ink in the ink flow channel while allowing air to vent through the oleophobic membrane and out of the ink flow channel, the oleophobic membrane including nanoparticles including nanoparticles that are disposed on, within, or both on and within the oleophobic membrane; and a mechanical backing attached to the oleophobic membrane, the mechanical backing having a mechanical strength sufficient to prevent deformation of the membrane, wherein the mechanical backing comprises openings having diameter that is at least two orders of magnitude greater than the mean membrane pore diameter; and a seal configured to seal the oleophobic membrane to the ink flow channel between the mechanical backing and the ink flow channel.

7. The ink jet subassembly of claim 6, wherein the mechanical backing comprises glass filled PTFE.

8. A method of operating an ink jet printer, comprising:

moving phase change ink through an ink flow channel located in a manifold of an ink jet print head;

confining the ink within the ink flow channel using an oleophobic membrane and a mechanical backing attached to the oleophobic membrane, the oleophobic membrane sealed across the ink flow channel and comprising nanoparticles disposed on, within, or on and within the oleophobic membrane, the mechanical backing having a mechanical strength sufficient to prevent deformation of the oleophobic membrane; and simultaneously venting air through the oleophobic membrane and out of the ink flow channel.

9. The method of claim 8 wherein the oleophobic membrane has a pore size and ink contact angle such that a bleed through pressure for the ink is larger than the maximum operating pressure in the ink flow channel.

10. The method of claim 9, wherein:

a bleed through pressure of the oleophobic membrane is greater than about 8 psi;

a pore size of the oleophobic membrane is greater than or equal to about 0.5 microns; and further comprising pressurizing the print head to a pressure of about 5 psi during normal operation.

11. A method of making an ink jet subassembly, comprising:

forming a bubble mitigation device comprising an oleophobic membrane including attaching a mechanical backing to the oleophobic membrane; and sealing the bubble mitigation device across a flow channel disposed within an ink jet printer, the bubble mitigation device arranged to retain ink in the flow channel and to vent air out of the flow channel through the oleophobic membrane, wherein the mechanical backing has a mechanical strength sufficient to prevent deformation of the oleophobic membrane and the oleophobic membrane includes nanoparticles that are disposed on, within, or both on and within the oleophobic membrane.

12. The method of claim 11, forming the bubble mitigation device comprises attaching a structural support having openings to the oleophobic membrane.

13. The method of claim 12, wherein sealing the bubble mitigation device across the flow channel comprises adhering the oleophobic membrane to one or more flow channel sides.

14. The method of claim 11, wherein forming the bubble mitigation device comprises using an oleophobic membrane comprising an oleophobic material electrospun with a base material that is non-oleophobic.

15. The method of claim 11, wherein forming the bubble mitigation device comprises using an oleophobic membrane comprising a base material coated with an oleophobic material.

16. The method of claim 11, wherein forming the bubble mitigation device comprises using an oleophobic membrane that has nanoparticles disposed within and/or on the oleophobic membrane.

* * * * *